US009489006B2

(12) United States Patent
Harimoto et al.

(10) Patent No.: US 9,489,006 B2
(45) Date of Patent: Nov. 8, 2016

(54) REACTION FORCE GENERATOR

(71) Applicant: YAMAHA CORPORATION, Hamamatsu-shi, Shizuoka-ken (JP)

(72) Inventors: Hiroshi Harimoto, Hamamatsu (JP); Ichiro Osuga, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 14/612,470

(22) Filed: Feb. 3, 2015

(65) Prior Publication Data

US 2015/0220105 A1 Aug. 6, 2015

(30) Foreign Application Priority Data

Feb. 6, 2014 (JP) ..... 2014-021719

(51) Int. Cl.

| | |
|---|---|
| ***H01H 1/14*** | (2006.01) |
| ***G05G 5/03*** | (2008.04) |
| ***H01H 13/705*** | (2006.01) |
| *H01H 13/85* | (2006.01) |

(52) U.S. Cl.

CPC ..... *G05G 5/03* (2013.01); *H01H 13/705* (2013.01); *H01H 13/85* (2013.01); *H01H 2215/006* (2013.01); *H01H 2215/026* (2013.01); *H01H 2221/016* (2013.01)

(58) Field of Classification Search

CPC ..... H01H 13/705; H01H 1/14; G05G 5/03

USPC ..... 200/239, 343, 513

See application file for complete search history.

(56) References Cited

U.S. PATENT DOCUMENTS

| | | | | |
|---|---|---|---|---|
| 4,079,651 | A | 3/1978 | Matsui | |
| 4,257,305 | A * | 3/1981 | Friend | G10H 1/0558 338/114 |
| 5,717,176 | A * | 2/1998 | Dahlstrom | H01H 13/64 200/1 B |
| 6,275,138 | B1 * | 8/2001 | Maeda | H01C 10/106 338/128 |

(Continued)

FOREIGN PATENT DOCUMENTS

| | | | |
|---|---|---|---|
| JP | 2007025576 | A | 2/2007 |
| WO | 2008140702 | A2 | 11/2008 |

OTHER PUBLICATIONS

European Search Report issued in EP15153571 dated Jun. 17, 2015.

(Continued)

*Primary Examiner* — Kyung Lee

(74) *Attorney, Agent, or Firm* — Rossi, Kimms & McDowell LLP

(57) ABSTRACT

A reaction force generator includes: a base member mounted on a supporter supporting an operating member pivotably; a dome member protruding from the base member; and a top member provided on a protruding-side end of the dome member to be pressed by the operating member toward the base member. The dome member is deformed to produce a reaction force when the top member is pressed by the operating member. A basal-end-side plane and a distal-end-side plane intersect each other at a position located on one of opposite sides of the dome member which is nearer to a pivot fulcrum of the operating member. The basal-end-side plane includes a line of intersection between the base member and the dome member adjacent to each other. The distal-end-side plane includes a line of intersection between the dome member and the top member adjacent to each other.

10 Claims, 10 Drawing Sheets

(56) References Cited

U.S. PATENT DOCUMENTS

| | | | | |
|---|---|---|---|---|
| 7,256,359 | B2 * | 8/2007 | Nishida | G10H 1/346 200/1 B |
| 7,427,723 | B2 * | 9/2008 | Watanabe | G10H 1/344 200/343 |
| 8,624,140 | B2 * | 1/2014 | Nishino | H01H 3/122 200/302.2 |
| 2007/0295192 | A1 * | 12/2007 | Watanabe | G10H 1/344 84/423 R |
| 2015/0064515 | A1 | 3/2015 | Brazier et al. | |

OTHER PUBLICATIONS

Keyboard Technology—Wikipedia, the free encyclopedia; Jan. 30, 2014. XP055193130, Retrieved from the Internet: URL:http://en.wikipedia.org/w/index.php?title=Keyboard_technology&oldid=593183413. Retrieved on Jun. 2, 2015. Abstract; Figures 1-3; pp. 1-7.

* cited by examiner

REACTION FORCE GENERATOR

CROSS REFERENCE TO RELATED APPLICATION

The present application claims priority from Japanese Patent Application No. 2014-021719, which was filed on Feb. 6, 2014, the disclosure of which is herein incorporated by reference in its entirety.

BACKGROUND

1. Technical Field

The present invention relates to a reaction force generator and more particularly to a reaction force generator configured to generate a reaction force when pressed by an operating member.

2. Description of the Related Art

There is conventionally known a reaction force generator configured to generate a reaction force against an operating member depressed and pivoted by an operator. The reaction force generator includes a protruding dome member made of an elastic material such as rubber. When the reaction force generator is pressed by the operating member, the dome member is deformed, causing the reaction force generator to generate a reaction force against the operating member due to the deformation. Patent Document 1 (Japanese Patent Application Publication No. 2007-25576) discloses such a reaction force generator, for example.

A key operation detection device (i.e., the reaction force generator) disclosed in Patent Document 1 includes a plurality of key switches provided in a resilient protrusion (i.e., the dome member). The key switches are respectively supported by resilient protruding portions specific to the respective key switches. With this construction, when the key operation detection device is pressed by the key as the operating member, the resilient protrusion and the resilient protruding portions specific to the respective key switches are deformed to generate reaction forces. During deformation, a buckling phenomenon occurs on the resilient protrusion, so that a roof of the resilient protrusion is bent inward. The reaction force generated by the deformation of the resilient protrusion greatly changes before and after the buckling phenomenon. Also, a rate of deformation differs between a portion of the resilient protrusion nearer to a pivot fulcrum of the key and a portion of the resilient protrusion farther from the pivot fulcrum, so that the buckling phenomenon occurs at different timings on the portion of the resilient protrusion nearer to the pivot fulcrum and the portion of the resilient protrusion farther from the pivot fulcrum. Accordingly, each time when the buckling phenomenon occurs on the portion of the resilient protrusion nearer to the pivot fulcrum and the portion of the resilient protrusion farther from the pivot fulcrum, the reaction force generated by the key operation detection device greatly changes, inhibiting a smooth change of the reaction force within a range of the pivotal movement of the key (see FIG. 11). As a result, when depressing the key with a finger, the operator may feel uncomfortable with a feel of the depression. For example, the operator may feel a reaction force at a plurality of timings during operation of the key and may feel a reaction force unexpected by the operator.

SUMMARY

This invention has been developed to provide a reaction force generator capable of smoothing a change in a reaction force during operation on an operating member.

The present invention provides a reaction force generator including: a base member mounted directly or indirectly on a supporter supporting an operating member pivotably; a dome member protruding from the base member; and a top member provided on a protruding-side distal end of the dome member and configured to be pressed by the operating member toward the base member. The dome member is configured to be elastically deformed to produce a reaction force when the top member is pressed by the operating member. The dome member is configured such that a basal-end-side plane and a distal-end-side plane intersect each other at a position located on one of opposite sides of the dome member which is nearer to a pivot fulcrum of the operating member than another of the opposite sides. The basal-end-side plane includes a line of intersection between the base member and the dome member adjacent to each other. The distal-end-side plane includes a line of intersection between the dome member and the top member adjacent to each other.

In the reaction force generator constructed as described above, a rate of deformation of the dome member is made generally uniform in the entire dome member when the dome member is pressed by the operating member, preventing local deformation. This makes it possible to smooth a characteristic of a reaction force acting on the operating member due to the deformation of the dome member, which improves a feel of press when an operator presses the operating member with his or her finger.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

First Embodiment

Figure 1A:
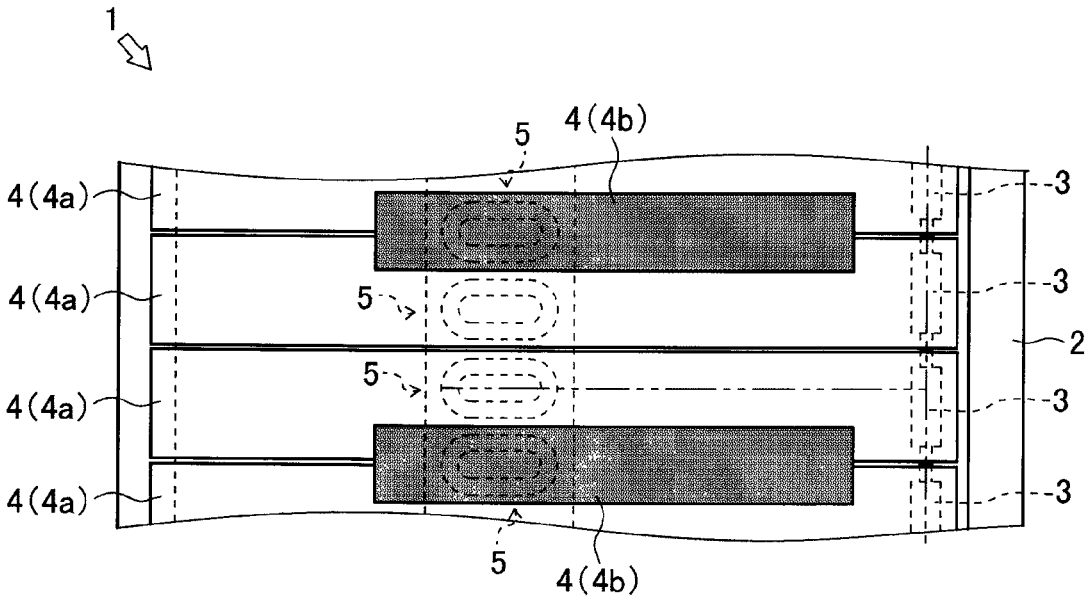
FIG. 1A is a top view partly illustrating a construction of a keyboard device including a reaction force generator according to one embodiment of the present invention.

There will be explained a keyboard device 1 in one embodiment of the present invention with reference to FIG. 1. In the present embodiment, the keyboard device 1 is a keyboard device of an electronic keyboard instrument.

The keyboard device 1 includes a frame (as one example of a supporter) 2, an upper-limit stopper 2*a*, a key fulcrum members 3, a plurality of keys 4 (including white keys 4*a* and black keys 4*b*), and a plurality of reaction force generators 5. The keyboard device 1 is disposed on the frame 2 as the supporter such that the keys 4 (the white keys 4*a* and the black keys 4*b*) are adjacent to each other. Each of the keys 4 is provided such that one end of the key 4 is pivotably supported by a corresponding one of the key fulcrum members 3 provided on the frame 2, via a pivot shaft 3*a* as a pivot fulcrum, and the other end of the key 4 is held in contact with the upper-limit stopper 2*a* provided on the frame 2. Also, the reaction force generators 5 and a plurality of key switches, not shown, are provided on the frame 2 so as to correspond to the respective keys 4. That is, the keys 4, the reaction force generators 5 corresponding to the respective keys 4, and the key switches, not shown, are provided on the frame 2 so as to be adjacent to each other in a direction in which the keys 4 are arranged.

When one of the keys 4 is depressed by an operator (see the black arrow in FIG. 1B), the key switch, not shown, corresponding to the operated key 4 is depressed to produce a musical sound signal, and the reaction force generator 5 corresponding to the depressed key 4 is compressed and deformed to generate a reaction force with respect to the depression of the key 4.

Figure 2A:
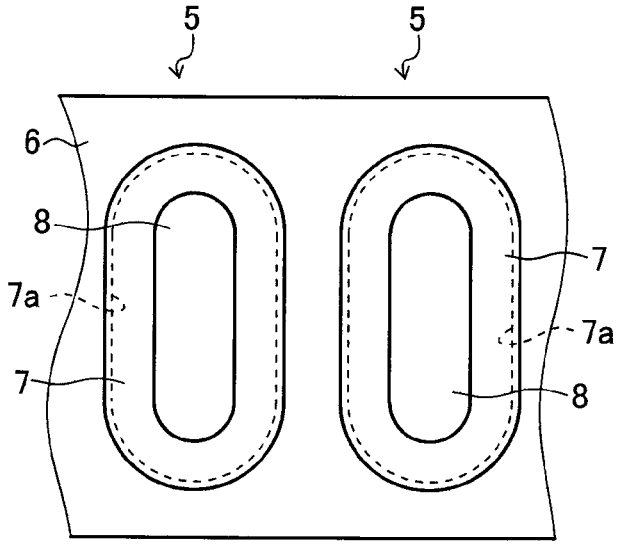
FIG. 2A is an enlarged top view illustrating reaction force generators according to a first embodiment of the present invention.
Figure 2B:
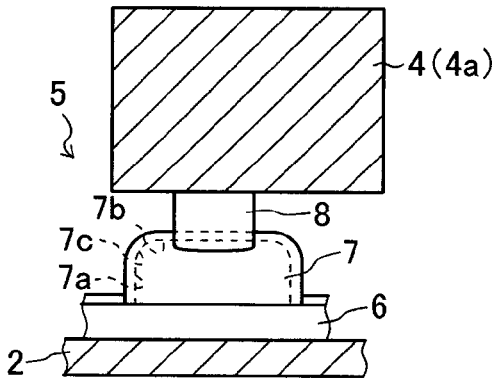
FIG. 2B is an enlarged front elevational view illustrating the reaction force generator.
Figure 2C:
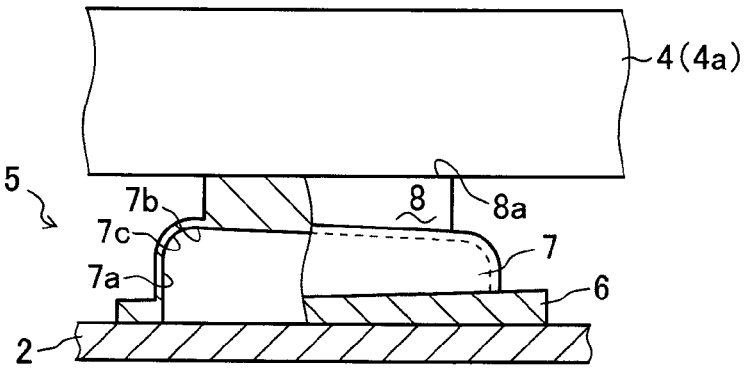
FIG. 2C is an enlarged side cross-sectional view partly illustrating the reaction force generator.

There will be next explained the reaction force generators 5 according to the first embodiment of the present invention with reference to FIGS. 2A-2C. Each of the reaction force generators 5 generates a reaction force against the operation of the operator on the key 4 as the operating member (hereinafter may be simply referred to as "reaction force"). As illustrated in FIG. 2, each of the reaction force generators 5 is formed of an elastic material such as silicon rubber and includes a dome member 7 and a top member 8. The reaction force generators 5 share a base member 6.

The base member 6 shaped like a plate fixes positions of the respective reaction force generators 5. The base member 6 is provided with a plurality of fixing protrusions, not shown, formed on a one-side surface of the base member 6, and this one-side surface is fixed to the frame 2 of the keyboard device 1 by the fixing protrusions while being held in close contact with the frame 2. A plurality of dome members 7 are formed on the other-side surface of the base member 6. It is noted that it is possible to consider that a plurality of base members 6 are integrally formed. While the base member 6 is provided, or the base members 6 of the respective reaction force generators 5 are integrally formed in the present embodiment, each of the dome members 7 may be formed on a corresponding one of the base members 6.

The dome member 7 generates the reaction force. The dome member 7 is shaped like a hollow dome expanded and protruding from the other-side surface of the base member 6 toward the key 4 of the keyboard device 1. Specifically, as illustrated in FIG. 2A, the dome member 7 includes a side wall 7*a* having an oval shape (or an elongated hole shape) in which a straight line connects between a pair of arcs spaced apart from each other in plan view when viewed from the other side of the base member 6, and this side wall 7*a* protrudes from the other-side surface of the base member 6. As illustrated in FIGS. 2B and 2C, the dome member 7 includes a roof 7*b* on the side wall 7*a* such that the roof 7*b* covers a space surrounded by the side wall 7*a* from above. The side wall 7*a* and the roof 7*b* of the dome member 7 are formed integrally with each other by being smoothly connected to each other via a curved surface 7*c*. The top member 8 is formed on a distal end of the roof 7*b* of the dome member 7. That is, a basal end of the dome member 7 is formed on the base member 6 integrally with each other, and the top member 8 is formed on a distal (i.e., protruding-side) end of the dome member 7 integrally with each other.

The top member 8 is depressed by the key 4 of the keyboard device 1. As illustrated in FIG. 2, the top member 8 protrudes from the roof 7*b* of the dome member 7 to the key 4 of the keyboard device 1. Specifically, the top member 8 is formed such that a solid table having an oval shape in plan view when viewed from the other side of the base member 6 protrudes from the roof 7*b* of the dome member 7. That is, the top member 8 is formed integrally with the roof 7*b* of the dome member 7 and partly constitutes the roof 7*b* of the dome member 7. The top member 8 is disposed such that a center line thereof in its longitudinal direction coincides with a center line of the dome member 7 in its longitudinal direction. A distal (i.e., protruding-side) end portion of the top member 8 has a contact surface 8*a* held in contact with the key 4.

Figure 1B:
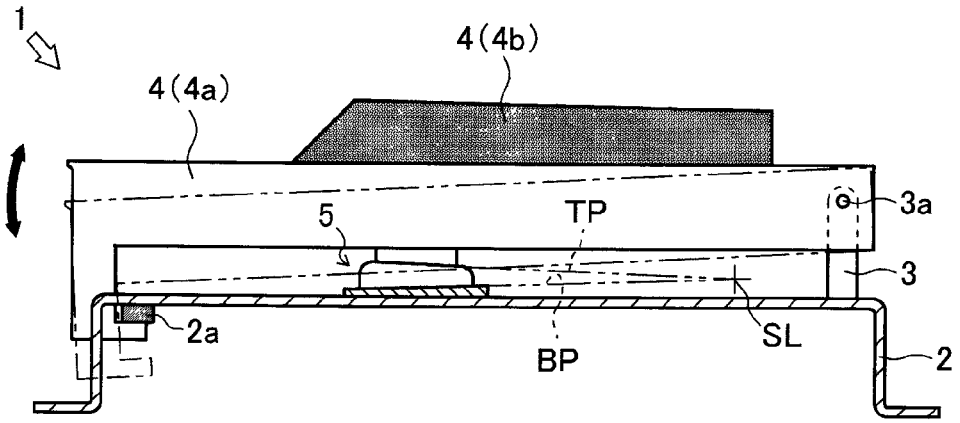
FIG. 1B is a side elevational view in cross section illustrating the keyboard device.

As illustrated in FIG. 1A, each reaction force generator 5 is disposed such that the center line of the oval dome member 7 in its longitudinal direction is perpendicular to the pivot shaft 3*a* of the key 4. As illustrated in FIG. 1B, the reaction force generator 5 is configured such that the entire contact surface 8*a* of the top member 8 is held in contact with the key 4 of the keyboard device 1 not being operated. That is, the reaction force generator 5 is configured such that the entire contact surface 8*a* of the top member 8 is always held in contact with the key 4 within a range of the operation of the key 4.

Figure 3A:
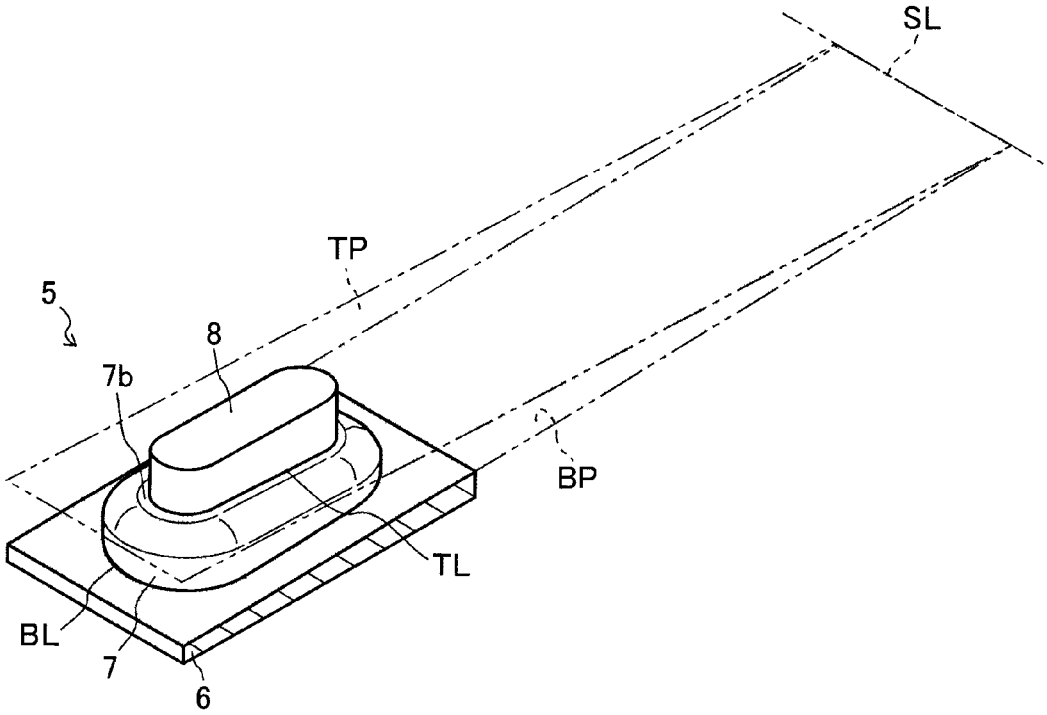
FIG. 3A is an enlarged perspective view illustrating a reference intersecting line between a basal-end-side plane and a distal-end-side plane in the reaction force generator according to the first embodiment of the present invention.
Figure 3B:
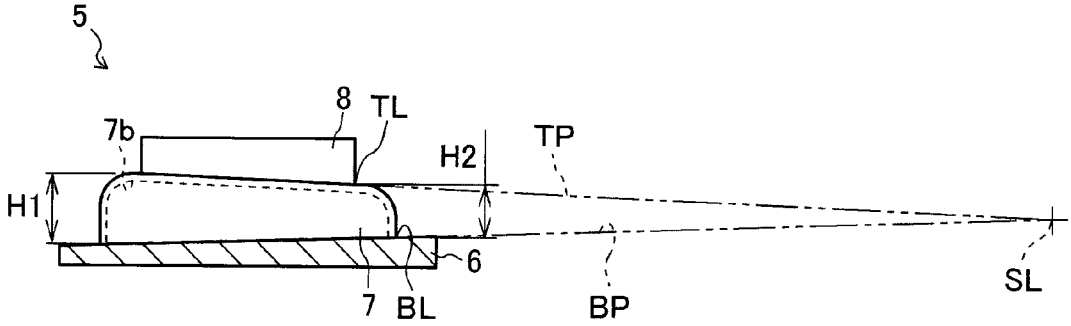
FIG. 3B is an enlarged side view illustrating the reference intersecting line.

There will be next explained the shape of the dome member 7 of the reaction force generator 5 in more detail with reference to FIGS. 1 and 3. As illustrated in FIGS. 1B and 3, the reaction force generator 5 is configured such that a basal-end-side plane BP and a distal-end-side plane TP intersect each other at a position located on one of opposite sides of the reaction force generator 5 which is nearer to the pivot shaft 3*a* of the key 4. The basal-end-side plane BP is defined by an intersecting line BL which is a line of intersection at a connected position of the base member 6 and the dome member 7 formed integrally with each other. The distal-end-side plane TP is defined by an intersecting line TL which is a line of intersection at a connected position of the dome member 7 and the top member 8 formed integrally with each other. That is, the basal-end-side plane BP is a virtual plane including the other-side surface of the base member 6 while the distal-end-side plane TP is a virtual plane including an outer surface of the roof 7*b* of the dome member 7, and the basal-end-side plane BP and the distal-end-side plane TP are not parallel with each other and intersect each other on a side of the reaction force generator 5 which is nearer to the pivot shaft 3*a*. In the present embodiment, the basal-end-side plane BP and the distal-end-side plane TP intersect each other at a position that differs from the position of the pivot shaft 3*a*.

Specifically, the reaction force generator 5 is configured such that each of the protruding height (length) of the side wall 7*a* and the curvature radius of the curved surface 7*c* increases in proportion to the shortest distance to the pivot shaft 3*a*, and the thickness of the base member 6 is uneven in accordance with the shape of the frame 2 of the keyboard device 1. That is, the reaction force generator 5 is configured such that the protruding height of the dome member 7 increases in proportion to the shortest distance from an intersecting line at which the basal-end-side plane BP and the distal-end-side plane TP intersect each other (hereinafter simply referred to as "reference intersecting line SL"), i.e., a distance between a point on the basal-end-side plane BP and the reference intersecting line SL. In other words, the protruding height of the dome member 7 at the point on the basal-end-side plane BP increases with increase in the distance between the point on the basal-end-side plane BP and the reference intersecting line SL. In the present embodiment, the thickness of the base member 6 decreases in proportion to the shortest distance from the pivot shaft 3*a*.

Figure 4A:
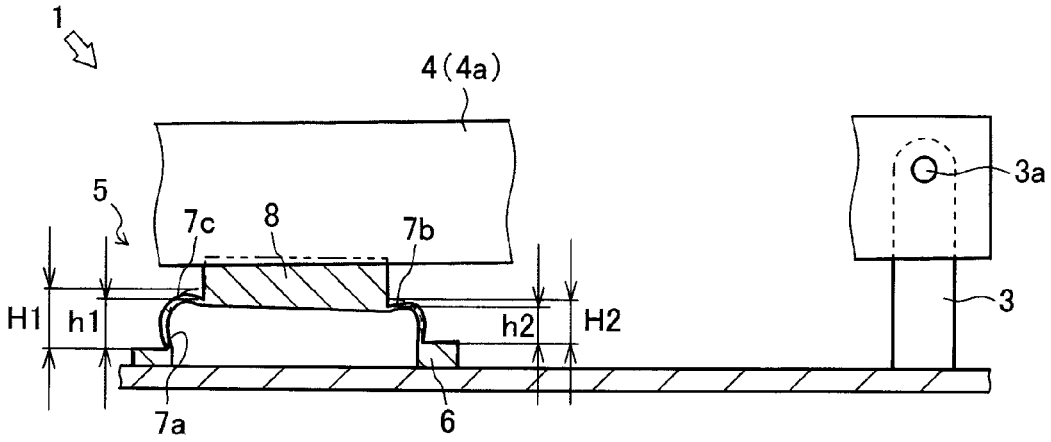
FIG. 4A is an enlarged side view schematically illustrating deformation in the reaction force generator according to the first embodiment of the present invention, in a state in which a buckling phenomenon has not occurred.
Figure 4B:
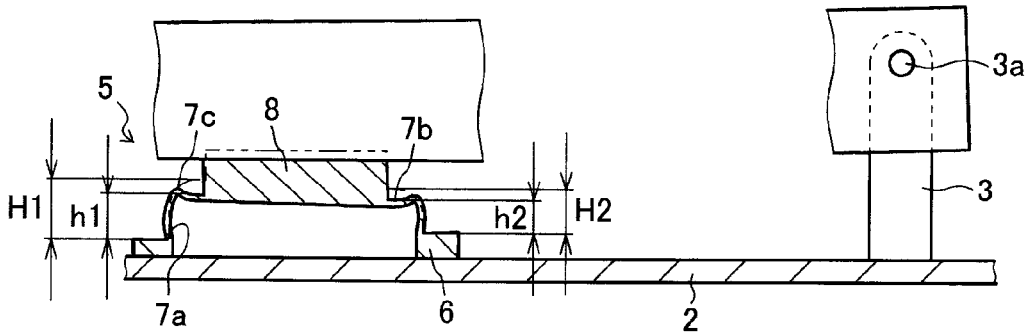
FIG. 4B is an enlarged side view schematically illustrating deformation in the reaction force generator in a state in which a buckling phenomenon has started.
Figure 4C:
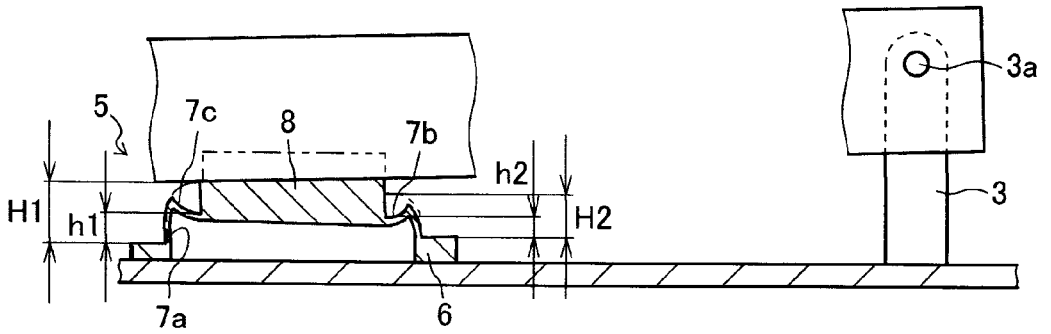
FIG. 4C is an enlarged side view schematically illustrating deformation in the reaction force generator in a state in which the buckling phenomenon has progressed.
Figure 5:
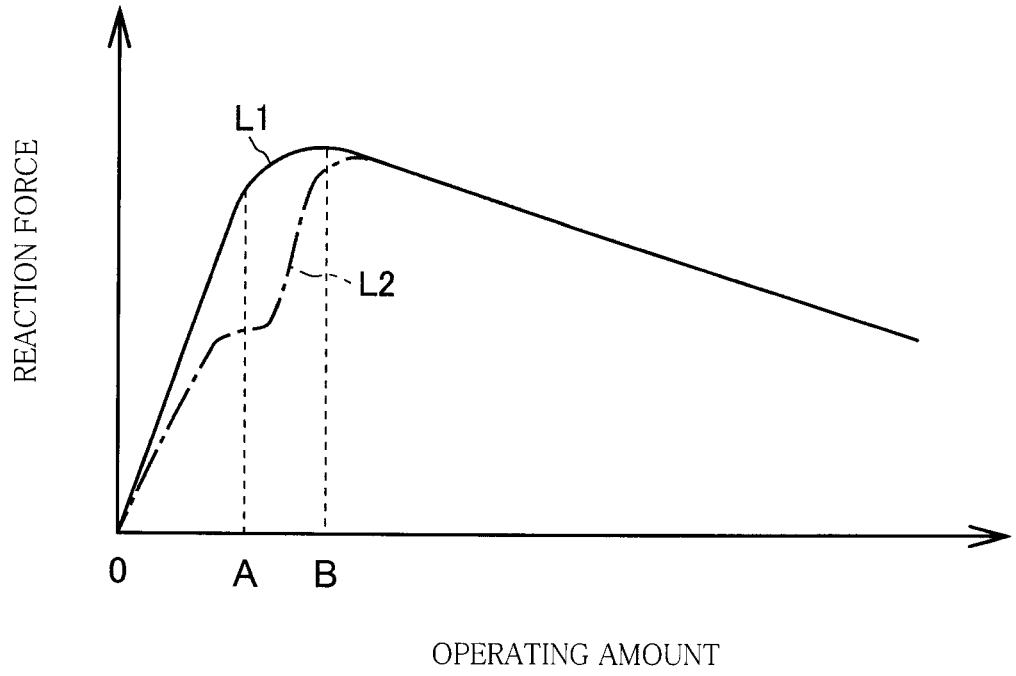
FIG. 5 is a graph illustrating a reaction force with respect to an amount of operation for the reaction force generator according to the present invention.

There will be next explained, with reference to FIGS. 4A-5, generation of the reaction force in the reaction force generator 5 according to the first embodiment of the present invention. Since the entire contact surface 8*a* of the top member 8 is always held in contact with the key 4 of the keyboard device 1, the top member 8 is depressed, following the depression of the key 4, at the same angle as the angle of pivotal movement of the key 4. That is, an amount of deformation of the reaction force generator 5 by the operation for the key 4 increases in proportion to the shortest distance from the pivot shaft 3*a*. When the top member 8 is depressed, the roof 7*b* of the dome member 7 is pressed into the space surrounded by the side wall 7*a*, and simultaneously the side wall 7*a* and the curved surface 7*c* are deformed while being folded into the space. With this construction, the reaction force generator 5 can use the deformation of the dome member 7 to generate the reaction force against the depression of the top member 8.

In the case where the key 4 of the keyboard device 1 is not operated, the dome member 7 is not deformed, and the contact surface 8*a* of the top member 8 is held in contact with the key 4. That is, since the deformation of the dome member 7 due to the depression of the key 4 is not caused, the reaction force generator 5 generates no reaction force (the case where the operating amount is zero in FIG. 5).

As illustrated in FIG. 4A, in the case where the key 4 of the keyboard device 1 is operated, the top member 8 is first pressed following the depression of the key 4. This depression of the top member 8 principally deforms or displaces the roof 7*b* of the dome member 7 into the dome member 7 (toward the base member 6) and deforms or displaces the side wall 7*a* of the dome member 7 toward an outside of the dome member 7. That is, the roof 7*b* and the curved surface 7*c* are deformed in a direction in which the top member 8 is depressed, and a reaction force generated due to the deformation of the roof 7*b* and the curved surface 7*c* deforms the side wall 7*a* in a direction perpendicular to the direction in which the top member 8 is depressed. In this reaction force generator 5, the amount of deformation of the side wall 7*a*, the roof 7*b*, and the curved surface 7*c* increases with increase in an amount of operation (operating amount) of the key 4. Accordingly, as indicated by the line L1 in FIG. 5, the reaction force is generated so as to increase with increase in the operating amount within a range less than or equal to an operating amount A which does not cause the buckling phenomenon on the dome member 7.

As illustrated in FIG. 4B, in the case where the key 4 of the keyboard device 1 is operated by an amount greater than the operating amount A, the buckling phenomenon starts occurring on the curved surface 7*c* so as to deform the dome member 7. Specifically, the curved surface 7*c* starts to be deformed in a direction in which the curved surface 7*c* is folded into the dome member 7. Most part of the amount of depression of the top member 8 is absorbed by the buckling phenomenon of the curved surface 7*c*. This reduces a rate of increase in the amount of deformation of the side wall 7*a* and a rate of increase in the amount of deformation of the roof 7*b*. Accordingly, as indicated by the line L1 in FIG. 5, a rate of increase in the reaction force decreases within a range in which the operating amount is greater than the operating amount A and less than or equal to an operating amount B which provides the largest reaction force.

As illustrated in FIG. 4C, in the case where the key 4 of the keyboard device 1 is operated by an amount greater than the operating amount B, the buckling phenomenon starts occurring also on the side wall 7*a*. Specifically, the curved surface 7*c* of the dome member 7 is completely folded into the dome member 7, and the side wall 7*a* of the dome member 7 starts to be deformed in a direction in which the side wall 7*a* is folded into the dome member 7. Most part of the amount of depression of the top member 8 is absorbed by the buckling phenomenon on the side wall 7*a* and the curved surface 7*c*. As a result, the amount of deformation of the side wall 7*a* and the amount of deformation of the roof 7*b* decrease. Accordingly, as indicated by the line L1 in FIG. 5, the reaction force decreases within a range in which the operating amount is greater than the operating amount B.

In the reaction force generator 5, an amount of unevenness in rate of the amount of deformation of the dome member 7 is reduced though the amount of depression of the top member 8 increases in proportion to the shortest distance to the pivot shaft 3*a* of the key 4. Accordingly, the entire dome member 7 is deformed at generally the same rate. For example, as illustrated in FIG. 4, a ratio of a protruding height h1 of the deformed dome member 7 to a protruding height H1 of the non-deformed dome member 7 is close to a ratio of a protruding height h2 (i.e., an amount of buckling) of the deformed dome member 7 to a protruding height H2 of the non-deformed dome member 7. Here, each of the protruding height h1 and the protruding height H1 is the height of a portion of the dome member 7 which is located on an opposite side of the top member 8 from the pivot shaft 3*a* and on which the amount of depression of the top member 8 is the largest, and each of the protruding height h2 and the protruding height H2 is the height of a portion of the dome member 7 which is located on a side of the top member 8 nearer to the pivot shaft 3*a* and on which the amount of depression of the top member 8 is the smallest.

In view of the above, the reaction force generated by the reaction force generator 5 greatly changes before and after the buckling phenomenon. In the conventional reaction force generator in which the basal-end-side plane BP and the distal-end-side plane TP are parallel with each other, the ratio of deformation differs between the portions of the dome member 7 which are respectively located nearer to and farther from the pivot shaft 3*a*, so that the buckling phenomenon occurs at different timings on the portions of the dome member 7 which are respectively located nearer to and farther from the pivot shaft 3*a*. Accordingly, in the conventional reaction force generator, as indicated by the line L2 in FIG. 5, each time when the buckling phenomenon occurs on portions of the roof which are respectively located nearer to and farther from the pivot shaft 3*a*, the reaction force greatly changes, whereby the reaction force does not smoothly change within the range of the pivotal movement of the key.

In the reaction force generator 5, on the other hand, the rate of the amount of deformation of the dome member 7 can be made generally uniform even in the construction in which the amount of depression of the top member 8 by the operation on the key 4 of the keyboard device 1 increases in proportion to the shortest distance to the pivot shaft 3*a*. Accordingly, the buckling phenomenon occurs generally at the same timing on the portions of the dome member 7 which are respectively located nearer to and farther from the pivot shaft 3*a*, that is, the great changes in the reaction force due to the buckling phenomenon are caused at generally the same timing. With this construction of the reaction force generator 5, even in the case where the buckling phenomenon occurs on the portions of the dome member 7 which are respectively located nearer to and farther from the pivot shaft 3*a*, it is possible to smooth a characteristic of the reaction force acting on the key 4 due to the deformation of the dome member 7. It is noted that since the reaction force generator 5 is formed of an elastic material, the reaction force generator 5 is elastically deformed to generate the reaction force by the depression of the key 4, and when the depressing force is released, the shape of the reaction force generator 5 returns to its original dome shape. While the release of the depression is needed to return the state of the key 4 to its initial state (i.e., a non-pushed key state), a spring or a hammer may be additionally provided to return the key 4 to its initial state using an action of the spring or the hammer, and alternatively, a return force of the reaction force generator 5 may be used to return the position of the key 4 to its initial position (i.e., the non-pushed key state).

Second Embodiment

Figure 6A:
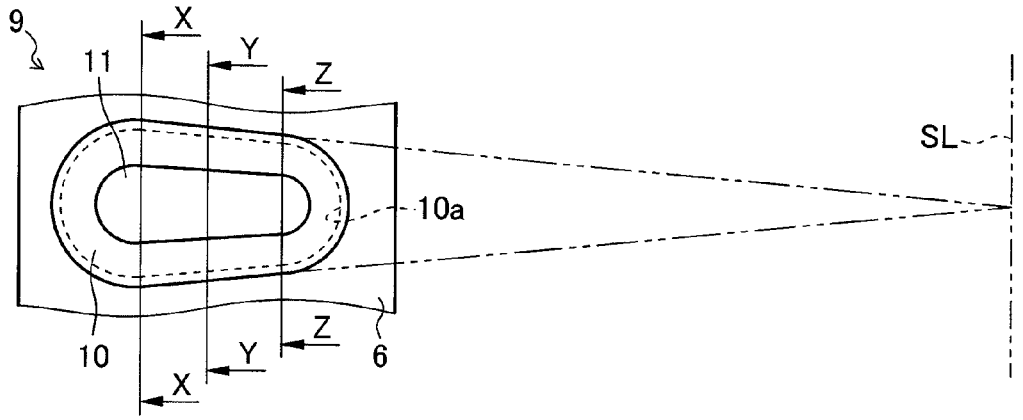
FIG. 6A is an enlarged top view illustrating a reaction force generator according to a second embodiment of the present invention.
Figure 6B:
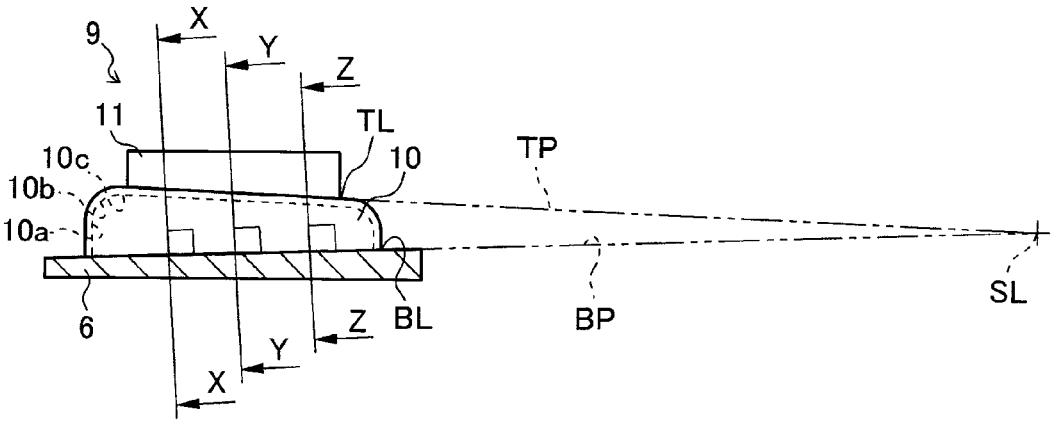
FIG. 6B is an enlarged side view illustrating the reaction force generator, and FIG. 6C are cross-sectional views respectively taken along lines X-X, Y-Y, and Z-Z in FIGS. 6A and 6B.
Figure 6C:
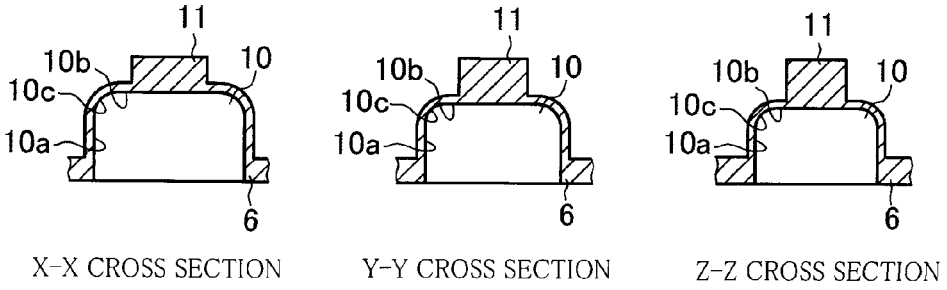

There will be next explained, with reference to FIGS. 6A-6C, a reaction force generator 9 according to a second embodiment of the present invention. It is noted that the same reference numerals as used in the first embodiment are used to designate the corresponding elements of this second embodiment, and an explanation of which is dispensed with. The reaction force generator 9 generates the reaction force against the operation on the key 4 as the operating member and includes the base member 6, a dome member 10, and a top member 11.

The dome member 10 is shaped like a hollow dome expanded and protruding from the other-side surface of the base member 6 toward the key 4 of the keyboard device 1. Specifically, the dome member 10 includes a side wall 10*a* having an oval shape (or an elongated hole shape) in which a straight line connects between a pair of arcs having different diameters and spaced apart from each other in plan view when viewed from the other side of the base member 6, and this side wall 10*a* protrudes from the other-side surface of the base member 6. The dome member 10 includes a roof 10*b* on the side wall 10*a* such that the roof 10*b* covers, from above, a space surrounded by the side wall 10*a*. The side wall 10*a* and the roof 10*b* of the dome member 10 are formed integrally with each other by being smoothly connected to each other via a curved surface 10*c*.

The top member 11 is shaped like a solid block protruding from the roof 10*b* of the dome member 10 toward the key 4 of the keyboard device 1. Specifically, the top member 11 is formed such that a table having an oval shape in which a straight line connects between a pair of arcs having different diameters and spaced apart from each other in plan view when viewed from the other side of the base member 6 protrudes from the roof 10*b* of the dome member 10. The top member 11 is disposed such that its center line in its longitudinal direction coincides with a center line of the dome member 10 in its longitudinal direction in a state in which a small-diameter portion of the top member 11 is located on the same side as a small-diameter portion of the dome member 10 having an oval shape in plan view when viewed from the other side of the base member 6.

As in the first embodiment in FIG. 1, the reaction force generator 9 is disposed such that its center line in its longitudinal direction is perpendicular to the pivot shaft 3*a* in a state in which the small-diameter portion of the dome member 10 faces toward the pivot shaft 3*a* of the key 4. The reaction force generator 9 is configured such that a size of a cross-sectional shape of the dome member 10 (i.e., the length or height of the cross-sectional shape of the dome member 10) on a plane parallel with the reference intersecting line SL (see FIG. 6A) and perpendicular to the basal-end-side plane BP (i.e., the other-side surface of the base member 6) (see FIG. 6B) increases with increase in the shortest distance to the reference intersecting line SL (see FIG. 6C).

That is, with reference to a shape of the dome member 10 which is assumed from a cross-sectional shape at a certain reference position (e.g., the position of the Y-Y cross section in FIG. 6), a size of the cross-sectional shape of the dome member 10 of the reaction force generator 9 (i.e., the length or height of the cross-sectional shape) decreases with decrease in the shortest distance from the reference intersecting line SL to the position of the cross section in an area in which the shortest distance is less than the shortest distance from the reference intersecting line SL to the reference position (see the Z-Z cross-sectional view in FIG. 6C). Likewise, a size of the cross-sectional shape of the dome member 10 of the reaction force generator 9 (i.e., the length or height of the cross-sectional shape) increases with increase in the shortest distance from the reference intersecting line SL to the position of the cross section in an area in which the shortest distance is greater than the shortest distance from the reference intersecting line SL to the reference position (see the X-X cross-sectional view in FIG. 6C).

Specifically, the dome member 10 of the reaction force generator 9 is configured such that the protruding height of the side wall 10*a* increases in proportion to the shortest distance to the reference intersecting line SL, and each of the distance between portions of the side wall 10*a* in a direction parallel with the reference intersecting line SL and the curvature radius of the curved surface 10*c* increases in proportion to the shortest distance to the reference intersecting line SL. The top member 11 of the reaction force generator 9 is configured such that its width in the direction parallel with the reference intersecting line SL increases in proportion to the shortest distance to the reference intersecting line SL.

In the reaction force generator 9 constructed as described above, the size of the shape of the dome member 10 (i.e., the length or height of the cross-sectional shape) increases with the amount of depression of the top member 11 which increases in proportion to the shortest distance to the pivot shaft 3*a* of the key 4. That is, since the size of the shape of the dome member 10 (i.e., the length or height of the cross-sectional shape) increases in proportion to the shortest distance to the pivot shaft 3*a*, the rate of the amount of deformation of the dome member 10 can be made generally uniform even in the construction of the reaction force generator 9 in which the amount of depression of the top member 8 by the operation on the key 4 of the keyboard device 1 increases in proportion to the shortest distance to the pivot shaft 3*a*. Accordingly, the buckling phenomenon occurs generally at the same timing on portions of the dome member 10 which are respectively located nearer to and farther from the pivot shaft 3*a*, that is, great changes in the reaction force due to the buckling phenomenon are caused at generally the same timing. Accordingly, it is possible to smooth a characteristic of the reaction force acting on the key 4 due to the deformation of the dome member 10.

Third Embodiment

Figure 7:
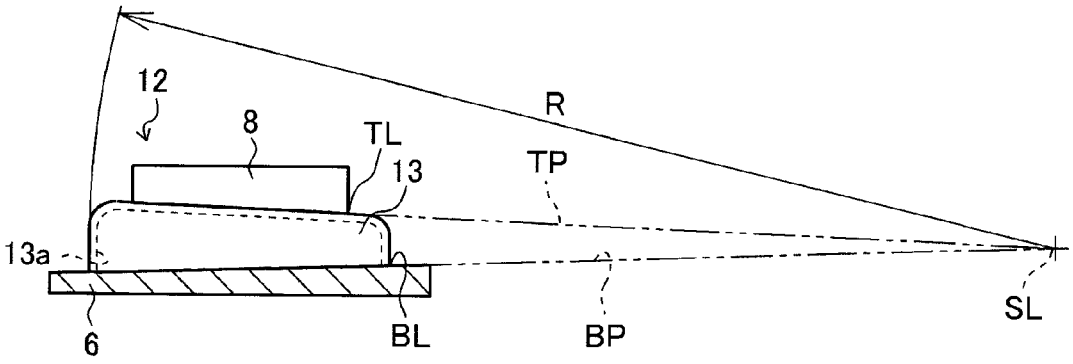
FIG. 7 is an enlarged side view illustrating a reaction force generator according to a third embodiment of the present invention.

There will be next explained, with reference to FIG. 7, a reaction force generator 12 according to a third embodiment of the present invention. The reaction force generator 12 according to the present embodiment has the same shape as that in the first embodiment and the second embodiment in top view (i.e., in plan view when viewed from the other side of the base member 6). In side view, as illustrated in FIG. 7, the reaction force generator 12 generates the reaction force against the operation on the key 4 as the operating member and includes the base member 6, a dome member 13, and the top member 8.

The dome member 13 is shaped like a hollow dome expanded and protruding from the other-side surface of the base member 6 toward the key 4 of the keyboard device 1. Specifically, the dome member 13 protrudes from the base member 6 such that a portion of a side wall 13*a* which is located on an opposite side of the top member 8 from the pivot shaft 3*a*, i.e., one of opposite portions of the side wall 13*a* in its longitudinal direction which is farther from the pivot shaft 3*a* of the key 4 than the other of the opposite portions has an arc shape centered about the reference intersecting line SL at a radius R. While the portion of the side wall 13*a* which is located on an opposite side from the pivot shaft 3*a* protrudes in the arc shape centered about the reference intersecting line SL in the present embodiment, the portion of the side wall 13*a* which is nearer to the pivot shaft 3*a* may also protrude in an arc shape centered about the reference intersecting line SL.

In the reaction force generator 12 constructed as described above, a side surface of the dome member 13 which extends in the longitudinal direction is formed so as to extend along a path of the pivotal movement of the key 4. That is, the reaction force generator 12 is configured such that even when the top member 8 is depressed by the depression of the key 4, a distance between the top member 8 and the side wall 13*a* does not increase. Accordingly, the dome member 13 is deformed generally uniformly in the buckling phenomenon regardless of the operating amount of the key 4, preventing local deformation. As a result, it is possible to smooth a characteristic of the reaction force acting on the key 4 due to the deformation of the dome member 13.

Fourth Embodiment

Figure 8A:
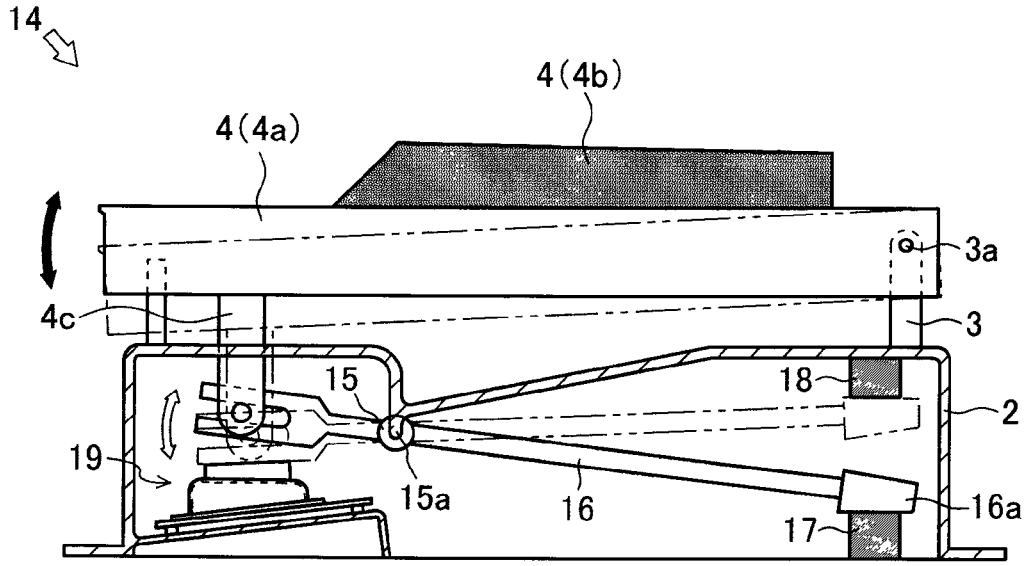
FIG. 8A is a side elevational view in cross section illustrating a keyboard device including a reaction force generator according to a fourth embodiment of the present invention.
Figure 8B:
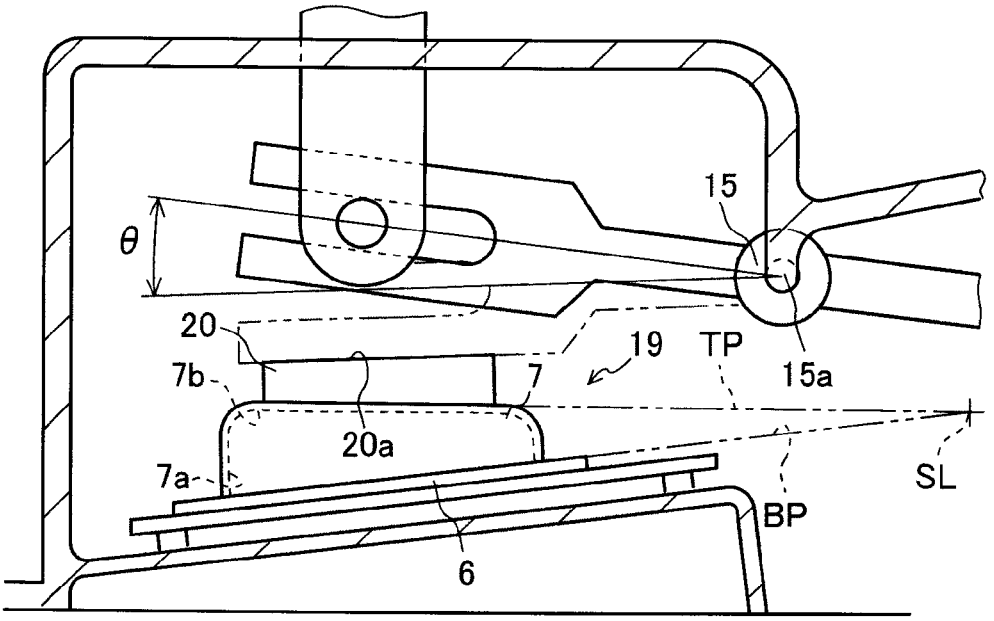
FIG. 8B is an enlarged side view illustrating the reaction force generator according to the fourth embodiment.

There will be next explained, with reference to FIGS. 8A and 8B, a reaction force generator 19 according to a fourth embodiment of the present invention. It is noted that the same reference numerals as used in the first embodiment are used to designate the corresponding elements of this fourth embodiment, and an explanation of which is dispensed with. The reaction force generator 19 is included in a keyboard device 14. The keyboard device 14 includes the frame 2, the key fulcrum members 3, the keys 4, a hammer fulcrum portion 15, a plurality of hammers 16, and a plurality of reaction force generators 19.

The hammers 16 are provided on the frame 2 so as to correspond to the respective keys 4. The hammer fulcrum portion 15 is provided on the frame 2, and each of the hammers 16 is pivotably supported at its midway portion by the hammer fulcrum portion 15 via a hammer pivot shaft 15*a*. One end portion of each hammer 16 is provided with a weight 16*a*, and a driving member 4*c* of the key 4 is connected to the other end portion of the hammer 16 which is located on an opposite side of the hammer fulcrum portion 15 from the one end portion. In this keyboard device 14, the frame 2 is provided with (i) a lower-limit stopper 17 with which the weight 16*a* of each hammer 16 is held in contact in the case where the key 4 is not operated and (ii) an upper-limit stopper 18 with which the weight 16*a* of the hammer 16 is held in contact in the case where the key 4 is operated. The reaction force generators 19 are provided on the frame 2 so as to correspond to the respective hammers 16.

When the key 4 is operated (see the black arrow in FIG. 8A), the hammer 16 connected to the driving member 4*c* of the key 4 is operated or pivoted about the hammer fulcrum portion 15 (see the white arrow in FIG. 8A). A reaction force is generated by the operated hammer 16, and the reaction force generator 19 is pressed by the hammer 16 so as to generate a reaction force.

The reaction force generator 19 according to the fourth embodiment will be explained in more detail. The reaction force generator 19 includes the base member 6, the dome member 7, and a top member 20 and is disposed on the frame 2 which supports the key 4 of the keyboard device 14 and the hammer 16 pivotably.

The top member 20 is shaped like a solid block protruding from the roof 7*b* of the dome member 7 to the hammer 16 of the keyboard device 14. A distal (i.e., protruding-side) end portion of the top member 20 has a contact surface 20*a* which can contact the hammer 16. When the hammer 16 is operated by an amount greater than or equal to a predetermined operating amount θ, the hammer 16 is held in contact with the entire contact surface 20*a* of the top member 20.

The reaction force generator 19 is configured such that when the hammer 16 is operated by an amount greater than or equal to the predetermined operating amount θ by the operation on the key 4 of the keyboard device 14, the top member 20 is depressed, following the operation on the hammer 16, at the same angle as the angle of the pivotal movement of the hammer 16. In this reaction force generator 19, the basal-end-side plane BP and the distal-end-side plane TP intersect each other at a position located on a side of the reaction force generator 19 which is nearer to the hammer fulcrum portion 15 of the reaction force generator 19. Accordingly, a portion of the dome member 7 is not deformed in a manner which greatly differs from a manner of another portion of the dome member 7 even in a state in which the reaction force generator 19 is not always held in contact with the hammer 16. That is, the rate of the deformation of the dome member 7 can be made generally uniform in the entire dome member 7 regardless of an amount of operation of the hammer 16 contacting the top member 20, preventing local deformation. As a result, it is possible to smooth the characteristic of the reaction force acting on the key 4 due to the deformation of the dome member 7.

Alternative Embodiments

It is noted that each of the reaction force generators 5, 9, 12, 19 according to the present invention is included in the keyboard device of the electronic keyboard instrument in the above-described explanation, but the present invention is not limited to this configuration, and the reaction force generator may have any construction as long as the reaction force generator includes an operating member to be operated. Also, as an alternative embodiment to the reaction force generators 5, 9, 12 according to the respective first, second and third embodiments, the dome member 7 may be configured such that the reference intersecting line SL coincides with an axis of the pivot shaft 3*a* of the key 4. Also, as an alternative embodiment to the reaction force generator 19 according to the fourth embodiment, the dome member 7 may be configured such that the reference intersecting line SL coincides with a center of the hammer fulcrum portion 15 of the keyboard device 14.

Figure 9:
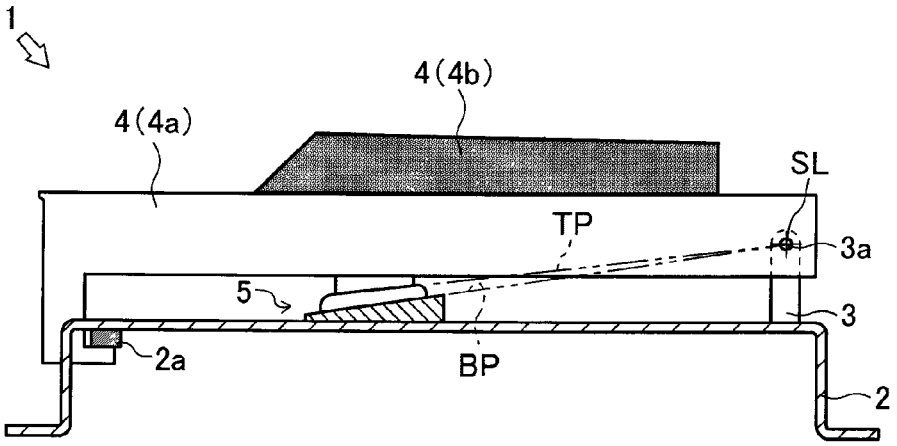
FIG. 9 is a side view illustrating a state in which the reference intersecting line between the basal-end-side plane and the distal-end-side plane coincides with a pivot shaft in the reaction force generator according to the first embodiment of the present invention.

For example, as illustrated in FIG. 9, the reaction force generator 5 according to the first embodiment may be configured such that the reference intersecting line SL coincides with the axis of the pivot shaft 3*a* of the key 4, whereby a ratio of the protruding height of the side wall 7*a* of the dome member 7 to the amount of depression of the top member 8 by the operation on the key 4 is made uniform in the entire dome member 7. In other words, the rate of the deformation of the dome member 7 by the depression of the key 4 is made uniform in the entire dome member 7. That is, the amount and manner of the deformation of the dome member 7 are made further uniform when compared with the case where the reference intersecting line SL does not coincide with the axis of the pivot shaft 3*a* of the key 4. As a result, it is possible to further smooth the characteristic of the reaction force acting on the key 4 due to the deformation of the dome member 7.

While the dome member 7 has the oval shape in plan view when viewed from the other side of the base member 6 in the reaction force generator 5, the present invention is not limited to this configuration. For example, the dome member 7 may have a round shape or an ellipse shape in plan view when viewed from the other side of the base member 6. Also, in the reaction force generator 5, the manner of deformation of the dome member 7 may be adjusted by adjusting not only the shape of the dome member 7 but also the thicknesses of the side wall 7*a*, the curved surface 7*c*, and the roof 7*b* of the dome member 7. This configuration can further smooth the characteristic of the reaction force acting on the key 4 due to the deformation of the dome member 7. This applies to the reaction force generators 9, 12, 19.

Figure 10:
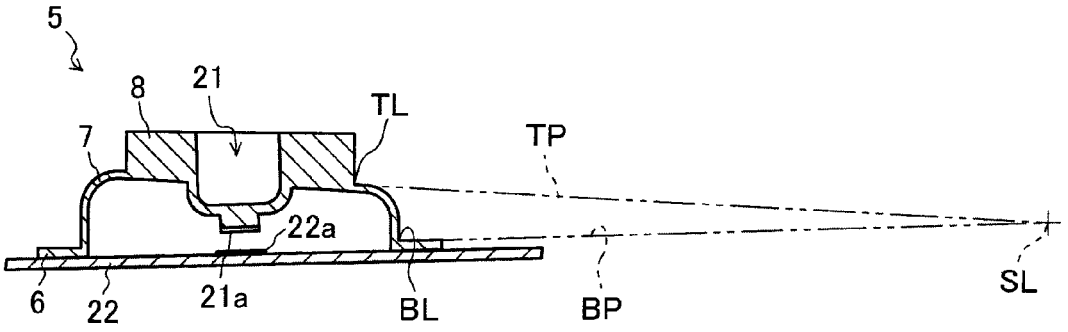
FIG. 10 is an enlarged side view illustrating a modification of the reaction force generator according to the first embodiment of the present invention, wherein this reaction force generator includes a key switch portion.
Figure 11:
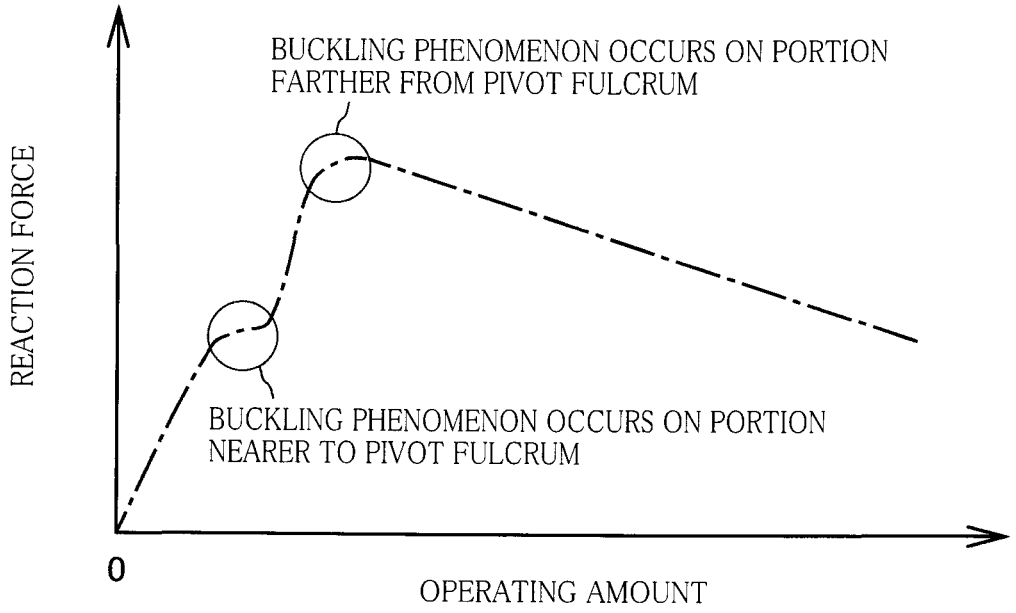
FIG. 11 is a graph illustrating a reaction force with respect to an amount of operation for a conventional reaction force generator.

As illustrated in FIG. 10, as an alternative embodiment to the reaction force generators 5, 9, 12, 19 according to the respective first, second, third and fourth embodiments, the reaction force generator may include at least one key switch portion 21. For example, in the reaction force generator 5 according to the first embodiment, the key switch portion 21 is shaped like a hollow bowl expanded and protruding from the top member 8 toward the base member 6. A base-member-side end portion of the key switch portion 21 is provided with a movable contact 21*a* formed of a conductive material such as carbon such that the movable contact 21*a* faces the base member 6.

The reaction force generator 5 constructed as described above is disposed on a board 22 for creating a musical sound signal, and the board 22 is provided on the frame 2. When the top member 8 is depressed by the depression of the key 4, the key switch portion 21 is deformed so as to move toward the board 22. When the operating amount of the key 4 reaches a predetermined amount, the movable contact 21*a* of the key switch portion 21 is brought into contact with a fixed contact 22*a* provided on the board 22 to produce a musical sound signal.

In the above-described embodiments, each of the top members 8, 11, 20 of the reaction force generators 5, 9, 12, 19 may not be solid and may be shaped like a tube protruding from a periphery of a corresponding one of the roofs 7*b*, 10*b*, 13*b* of the dome members 7, 10, 13.

In the reaction force generators 5, 9, 12 according to the first, second and third embodiments, the contact surface of each of the top members 8, 11 and the key 4 are always held in contact with each other, but the contact surface of each of the top members 8, 11 and the key 4 may be brought into contact with each other in the middle of the operation on the key 4.

While the shaft is used as the pivot fulcrum of the operating member (i.e., the key 4) in each of the embodiments, a pivotal end portion of the operating member may be provided with a hinge portion shaped like a thin plate which is bent to support the operating member pivotably. In this construction, the hinge portion corresponds to the pivot fulcrum.

While each of the reaction force generators 5, 9 is directly provided on the frame 2 in the first and second embodiments, an intermediate member such as a board may be provided on the frame 2, and the reaction force generator may be provided on this intermediate member like the reaction force generator 19 illustrated in FIGS. 8A and 8B and the reaction force generator 5 illustrated in FIG. 10. That is, the reaction force generator may be indirectly provided on the frame 2.

While the fixing protrusions are formed on the one-side surface of the base member 6, and the base member 6 is fixed to the frame 2 as a method for fixing the base member 6 of each of the reaction force generators 5, 9, 12, 19 to the frame 2 or the intermediate member, the base member 6 may be fixed to the frame 2 using any method including: a method in which fixing protrusions are provided on, e.g., the frame 2, and the base member 6 is fixed to the frame 2 by inserting the fixing protrusions respectively into holes formed in the base member 6; a method in which the base member 6 is bonded and fixed to, e.g., the frame 2; and other methods.

What is claimed is:

1. A reaction force generator comprising:

a base member mountable directly or indirectly on a supporter supporting an operating member pivotably;

a dome member protruding from the base member; and a top member integral with the dome member and provided on a protruding-side distal end of the dome member and configured to be pressed by the operating member toward the base member, wherein the dome member is configured to be elastically deformed to produce a reaction force when the top member is pressed by the operating member, wherein the dome member is configured so that:

a basal-end-side plane and a distal-end-side plane intersect each other at a line of intersection located on a first side of the dome member nearer to a pivot fulcrum of the operating member, the basal-end-side plane being a plane that includes a line of intersection between the base member and the dome member and the distal-end-side plane being a plane that includes a line of intersection between the dome member and the top member; and when the top member is pressed by the operating member, a rate of an amount of deformation in the first side of the dome member is generally the same as a rate of an amount of deformation in a second side of the dome member, the first side of the dome member being nearer to the pivot fulcrum of the operating member than the second side of the dome member.

2. The reaction force generator according to claim 1, wherein:

the dome member includes a side wall protruding from the base member, and a protruding height of the side wall increases with an increase in a distance from the line of intersection between the basal-end-side plane and the distal-end-side plane.

3. The reaction force generator according to claim 1, wherein:

the dome member comprises a side wall, a roof, and a curved surface portion connecting between the side wall and the roof, and a curvature radius of the curved surface portion increases with an increase in a distance from the line of intersection between the basal-end-side plane and the distal-end-side plane.

4. The reaction force generator according to claim 1, wherein a thickness of the base member decreases with an increase in a distance from the line of intersection between the basal-end-side plane and the distal-end-side plane.

5. The reaction force generator according to claim 1, wherein the line of intersection between the basal-end-side plane and the distal-end-side plane coincides with the pivot fulcrum of the operating member.

6. The reaction force generator according to claim 1, wherein a length of a cross-sectional shape of the dome member on a plane parallel with the line of intersection between the basal-end-side plane and the distal-end-side plane and perpendicular to the basal-end-side plane increases with an increase in a distance from the line of intersection between the basal-end-side plane and the distal-end-side plane.

7. The reaction force generator according to claim 1, wherein the dome member includes a side surface having an arc-shaped surface centered about the line of intersection between the basal-end-side plane and the distal-end-side plane.

8. The reaction force generator according to claim 1, further comprising:

a movable switch protruding from the top member toward the base member; and a fixed contact provided on the supporter.

9. A reaction force generator comprising:

a base member mountable directly or indirectly on a supporter supporting an operating member pivotably;

a dome member protruding from the base member; and a top member provided on a protruding-side distal end of the dome member and configured to be pressed by the operating member toward the base member, wherein the dome member is configured to be elastically deformed to produce a reaction force when the top member is pressed by the operating member, wherein the dome member is configured so that a basal-end-side plane and a distal-end-side plane intersect each other at a line of intersection located on a side of the dome member nearer to a pivot fulcrum of the operating member, the basal-end-side plane being a plane that includes a line of intersection between the base member and the dome member and the distal-end-side plane being a plane that includes a line of intersection between the dome member and the top member, wherein the dome member includes a side wall protruding from the base member, and wherein a protruding height of the side wall increases with an increase in a distance from the line of intersection between the basal-end-side plane and the distal-end-side plane.

10. A reaction force generator comprising:

a base member mountable directly or indirectly on a supporter supporting an operating member pivotably;

a dome member protruding from the base member; and a top member provided on a protruding-side distal end of the dome member and configured to be pressed by the operating member toward the base member, wherein the dome member is configured to be elastically deformed to produce a reaction force when the top member is pressed by the operating member, wherein the dome member is configured so that a basal-end-side plane and a distal-end-side plane intersect each other at a line of intersection located on a side of the dome member nearer to a pivot fulcrum of the operating member, the basal-end-side plane being a plane that includes a line of intersection between the base member and the dome member and the distal-end-side plane being a plane that includes a line of intersection between the dome member and the top member, wherein the dome member comprises a side wall, a roof, and a curved surface portion connecting between the side wall and the roof, and wherein a curvature radius of the curved surface portion increases with an increase in a distance from the line of intersection between the basal-end-side plane and the distal-end-side plane.

* * * * *